US008065847B2

(12) United States Patent
Gimpel et al.

(10) Patent No.: US 8,065,847 B2
(45) Date of Patent: Nov. 29, 2011

(54) MULTI-CONFIGURABLE TUBULAR DISPLAY SYSTEM

(75) Inventors: Dixon Gimpel, Prior Lake, MN (US); Joe Skull, Fridley, MN (US); Curtis H. Lindblom, Oakdale, MN (US)

(73) Assignee: Skyline Displays, Inc., Eagan, MN (US)

( * ) Notice: Subject to any disclaimer, the term of this patent is extended or adjusted under 35 U.S.C. 154(b) by 891 days.

(21) Appl. No.: 11/968,538

(22) Filed: Jan. 2, 2008

(65) Prior Publication Data

US 2009/0031664 A1 Feb. 5, 2009

Related U.S. Application Data

(60) Provisional application No. 60/878,476, filed on Jan. 3, 2007.

(51) Int. Cl.

| | |
|---|---|
| ***E04C 1/00*** | (2006.01) |
| ***E04C 3/02*** | (2006.01) |
| ***E04H 12/18*** | (2006.01) |
| ***E04H 12/00*** | (2006.01) |

(52) U.S. Cl. ..... 52/309.1; 52/633; 52/645; 52/646; 52/653.1; 52/653.2

(58) Field of Classification Search ..... 52/309.1, 52/633, 645, 646, 653.1, 653.2, 655.1; 403/169, 403/170, 217, 218, 219

See application file for complete search history.

(56) References Cited

U.S. PATENT DOCUMENTS

| | | | | |
|---|---|---|---|---|
| 4,641,983 | A | 2/1987 | Strassle | |
| 5,277,512 | A | 1/1994 | Dwillies | |
| 5,536,097 | A * | 7/1996 | Hazan | 403/171 |
| 5,549,408 | A * | 8/1996 | Lo | 403/218 |
| 5,651,630 | A * | 7/1997 | Nomura | 403/219 |
| 5,797,695 | A * | 8/1998 | Prusmack | 403/170 |
| 6,196,568 | B1 * | 3/2001 | Stevens | 280/304.1 |
| 6,205,739 | B1 * | 3/2001 | Newlin | 52/655.1 |
| 6,273,633 | B1 * | 8/2001 | Husson et al. | 403/218 |
| 6,615,562 | B2 * | 9/2003 | Fritsche et al. | 52/696 |
| 6,675,546 | B2 * | 1/2004 | Coles | 52/655.1 |
| 6,854,238 | B2 * | 2/2005 | Boots | 52/655.1 |
| 6,951,283 | B2 | 10/2005 | Savoie | |

(Continued)

FOREIGN PATENT DOCUMENTS

| | | |
|---|---|---|
| DE | 36 03 393 | 8/1987 |

(Continued)

*Primary Examiner* — Eileen D Lillis
*Assistant Examiner* — Mark Wendell
(74) *Attorney, Agent, or Firm* — Patterson Thuente Christensen Pedersen, P.A.

(57) ABSTRACT

An exhibit or display for tradeshows or the like having a plurality of support members and an axial connection assembly. The support members include opposing ends and a body portion, and further include an exterior channel and a central bore, the channel defining a flange portion and the bore being in communication with a retention feature. The axial connection assembly is configured to releasably couple an end of a first support member to an end of a second support member such that the two support members are axially aligned. The axial connection assembly includes a collar releasably coupled in the bore of each member, with each collar including at least one locator portion to interact with the retention feature, and a pin having a mid portion and two ends, the mid portion configured to be rotatably selectively restrained within the collar.

16 Claims, 16 Drawing Sheets

U.S. PATENT DOCUMENTS

| | | | | |
|---|---|---|---|---|
| 7,024,834 | B2 | 4/2006 | Gimpel et al. | |
| 7,530,549 | B1 * | 5/2009 | Hansen et al. | 256/60 |
| 2004/0055244 | A1 | 3/2004 | Gimpel et al. | |
| 2006/0024923 | A1 | 2/2006 | Sarma et al. | |
| 2006/0236640 | A1 | 10/2006 | Hung | |

FOREIGN PATENT DOCUMENTS

| | | |
|---|---|---|
| WO | WO 2004/001152 | 12/2003 |

* cited by examiner

MULTI-CONFIGURABLE TUBULAR DISPLAY SYSTEM

RELATED APPLICATION

The present application claims the benefit of U.S. Provisional Application No. 60/878,476, filed Jan. 3, 2007, which is incorporated herein in its entirety by reference.

FIELD

The present invention is related generally to exhibits. More particularly, the invention relates to collapsible portable exhibits or displays, such as used for tradeshows.

BACKGROUND

Exhibits for tradeshows and other marketing venues utilize eye catching and informative graphics and/or displays that are intended to inform and present an image to customers and potential customers. Typically, such exhibits must be set up and then disassembled in a limited amount of time. Therefore, the exhibits must be capable of being quickly erected and taken down.

Modifications or alterations to the exhibits may also be desirable or necessary. Therefore, it is preferable that the exhibits are easily reconfigurable, facilitating variations to the exhibit and potentially allowing at least the structural framework to be reused in alternate exhibit configurations.

Additionally, utilizing light-weight components that quickly couple together makes the task of assembling and disassembling the exhibit quicker and easier. The use of aluminum extrusion is popular for many applications, including framework in tradeshow exhibits. Extruded aluminum can be easily manufactured in an endless variety of shapes, sizes, and configurations, and is also typically lightweight and cost-effective.

Various systems and methods exist for connecting framework pieces. In the case of tradeshow exhibits, which are temporary installations and must be set-up and disassembled many times, it is necessary for the framework connections to be releasable. The exhibit can then be partially or totally disassembled, allowing the exhibit to be transported to the next tradeshow or to storage.

Typically, exhibits or displays are custom-made to suit a particular application. The exhibits are often only able to be assembled in one configuration, and modifications to the layout or configuration of the exhibit are not possible. Additionally, many exhibits are constructed from very large components that are difficult and awkward to handle, ship, and store.

It is thus desirable to have a framework and connection system that is inexpensive, lightweight, and capable of being quickly assembled and disassembled.

BRIEF SUMMARY

The exhibits, displays, and connection methods according to the various embodiments of the present invention overcome the deficiencies of conventional designs. In an example embodiment, an exhibit or display for tradeshows or the like is provided, having a plurality of support members and an axial connection assembly. The support members include opposing ends and a body portion, and further include an exterior channel and a central bore, the channel defining a flange portion and the bore being in communication with a retention feature. The axial connection assembly is configured to releasably couple an end of a first support member to an end of a second support member such that the two support members are axially aligned. The axial connection assembly includes a collar releasably coupled in the bore of each member, with each collar including at least one locator portion to interact with the retention feature, and a pin having a mid portion and two ends, the mid portion configured to be rotatably selectively restrained within the collar. A set screw in cooperation with each collar and extending into a circumferential groove(s) on the pin may be utilized to secure the pin within the collars and thus the support members. In the axial to axial connection a single pin will preferably extend in to two collars, one in each support member. The system supports connection of an end of a first support member to the body, intermediate the ends of another, a second, support member. The end of the first support member utilizes the collar with a pin securable in the collar and having or attachable thereto is a T-shaped member. The T-shaped member is insertable into the flanged channel on the body of the second support member. A faceplate formed of, for example a rigid polymer, may be attached to the end of the faceplate with axially extending protrusions to extend into voids in the end of the first support member and one or more axially extending protusions to engage with the channel of the second support member. A faceplate may also be used in the end to end connection described above.

A feature and advantage of certain embodiments of the invention include a robust connection system that utilizes a faceplate of a polymer material to prevent marring and provide a more robust connection between two tubular support members.

A feature and advantage of certain embodiments of the invention is that a single collar design may be utilized with alternative pin designs to either attach the end of a bored support member to the either another end of a support member or to the body of a support member at a flanged channel.

BRIEF DESCRIPTION OF THE DRAWINGS

The present invention can be more completely understood and appreciated by referring to the following more detailed description of the presently preferred exemplary embodiments of the invention in conjunction with the accompanying drawings, of which.

DETAILED DESCRIPTION OF THE DRAWINGS

In the following detailed description of the present invention, numerous specific details are set forth in order to provide a thorough understanding of the present invention. However, one skilled in the art will recognize that the present invention may be practiced without these specific details. In other instances, well-known methods, procedures, and components have not been described in detail so as to not unnecessarily obscure aspects of the present invention. Unless otherwise noted, the terms exhibit and display are used interchangeably throughout this description.

Figure 1:
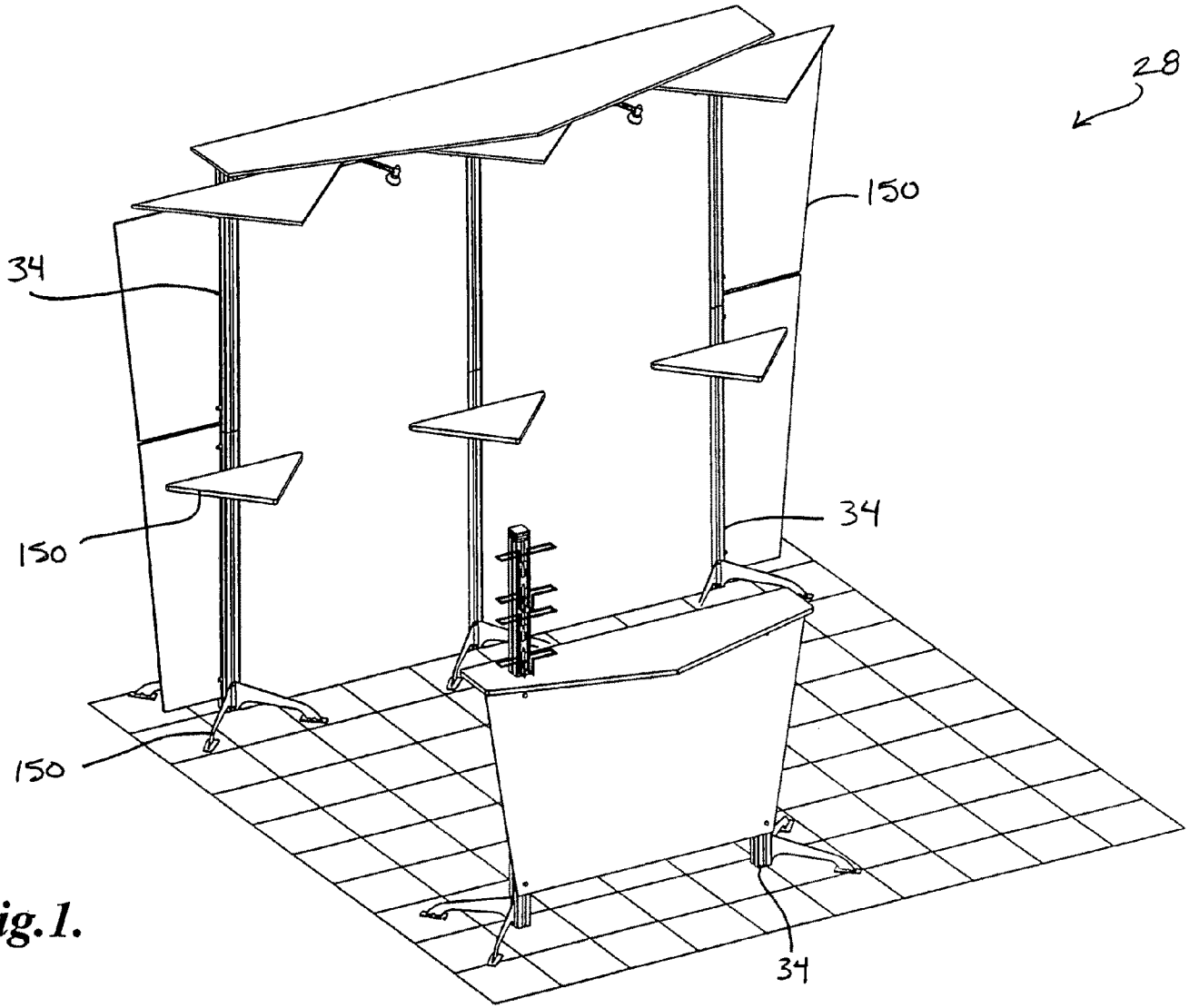
FIG. 1 is a perspective view of a multi-configurable exhibit according to an example embodiment of the present invention.
Figure 1A:
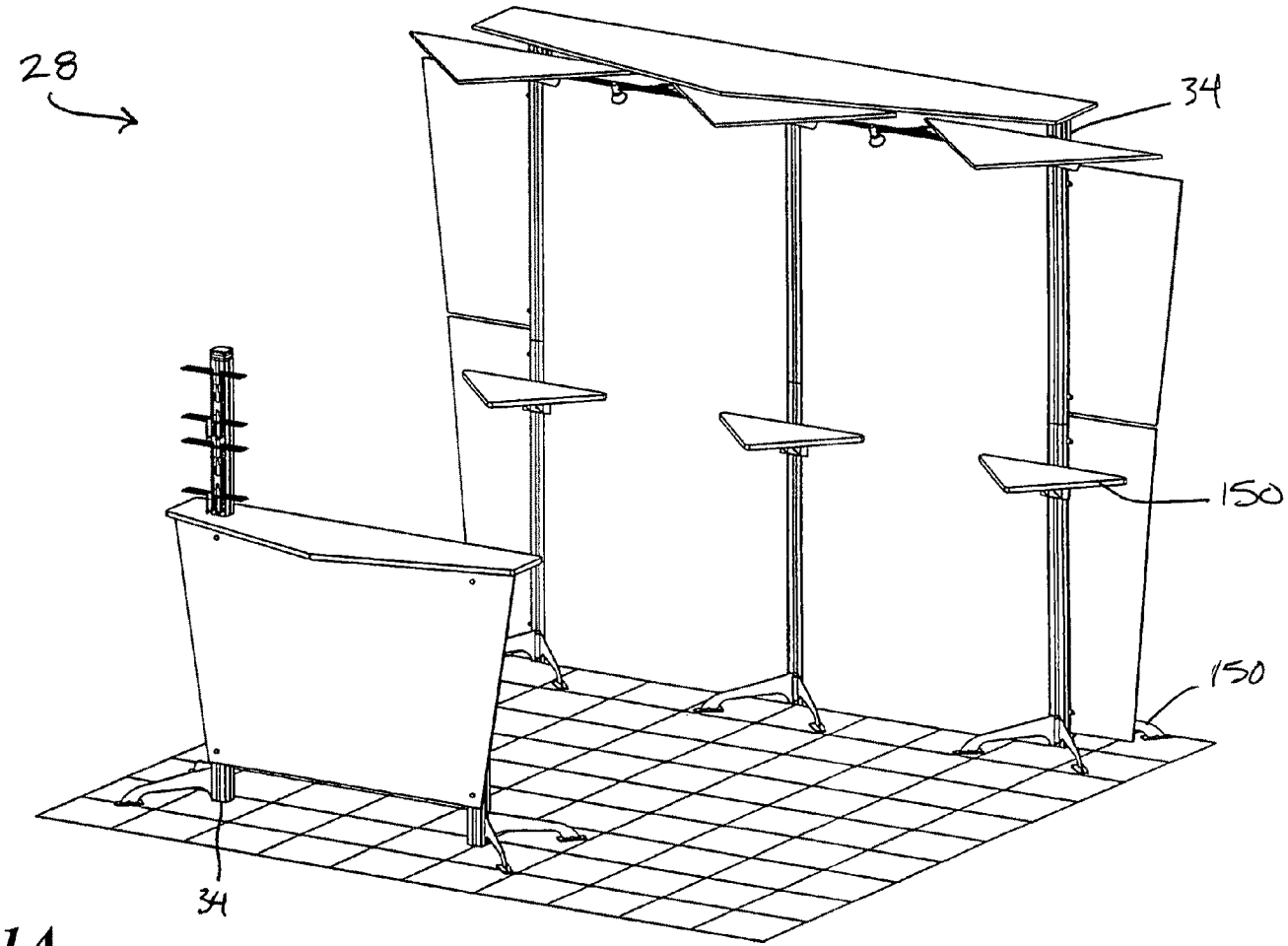
FIG. 1A is a further perspective view of a multi-configurable exhibit according to an example embodiment of the present invention.
Figure 1B:
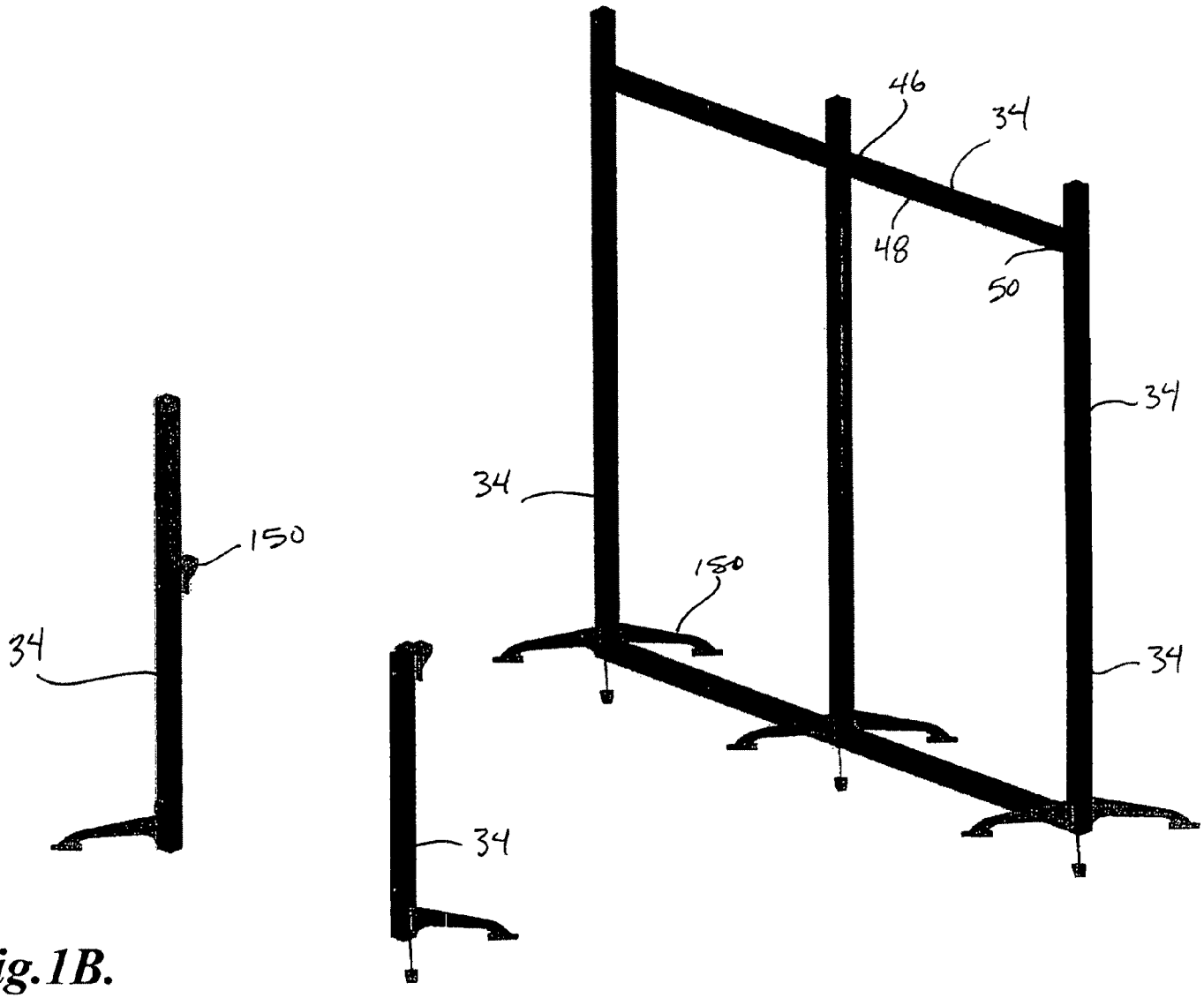
FIG. 1B is a perspective view of a partially disassembled multi-configurable exhibit according to an example embodiment of the present invention.

Referring to FIGS. 1-1B, multi-configurable exhibit 28 comprises a framework of identical tubular members 34, a connection assembly 30, an axial connection assembly 32, and one or more accessories 150. Tubular members 34 may be oriented vertically, horizontally, and diagonally to form an exhibit 28. Further, multiple tubular members 34 may be coupled end-to-end with axial connection assembly 32, or an end of a first tubular member may be coupled to the body portion of a second tubular member with connection assembly 30. Tubular members 34 may be cantilevered horizontally if desired, using connection assembly 30. The possible configurations and layouts of exhibit 28 are virtually endless, and example embodiments of exhibit 28 are depicted in FIGS. 1-1B.

Figure 2:
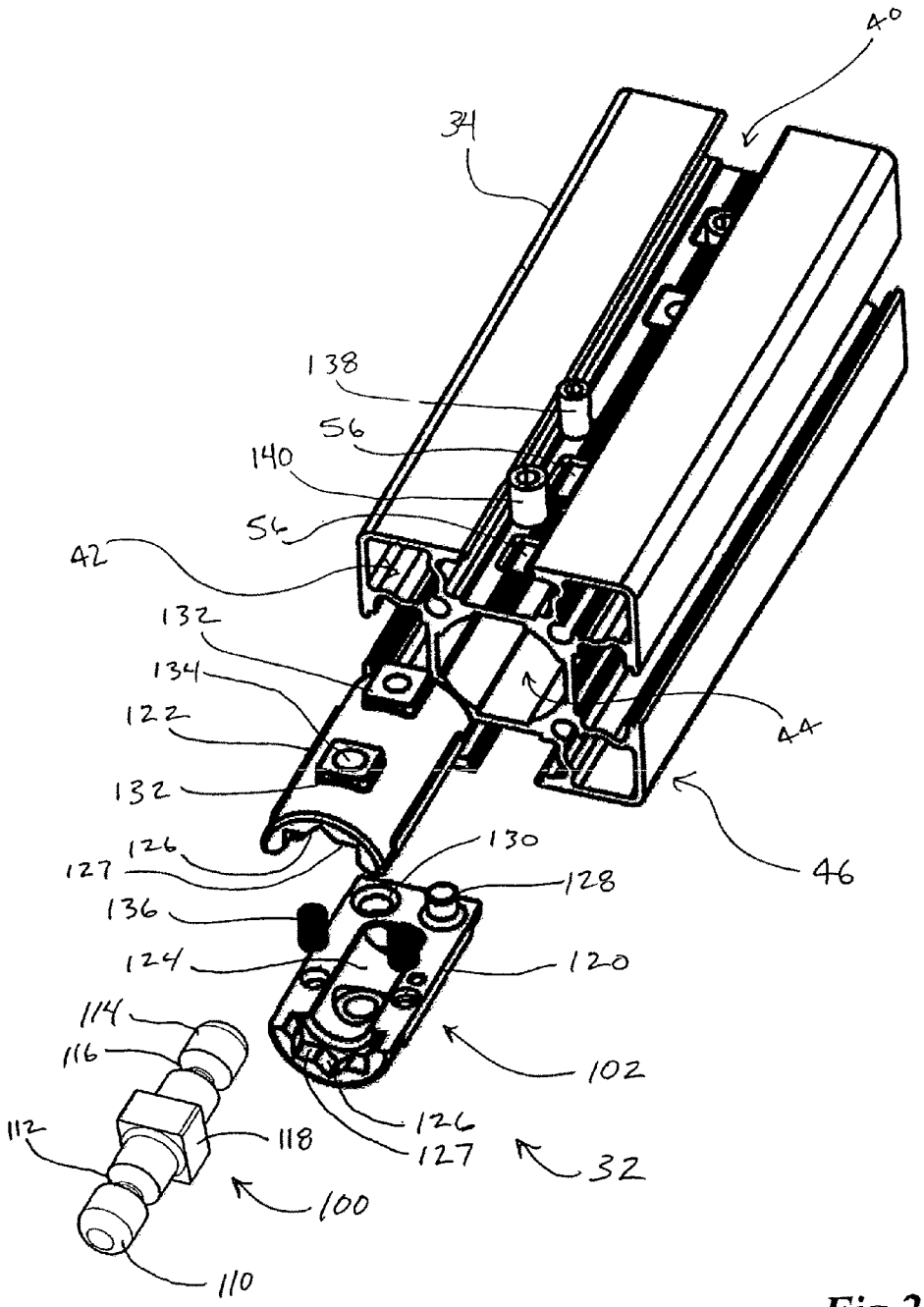
FIG. 2 is a perspective exploded view of a tubular member and a connection assembly according to an example embodiment of the present invention.
Figure 2A:
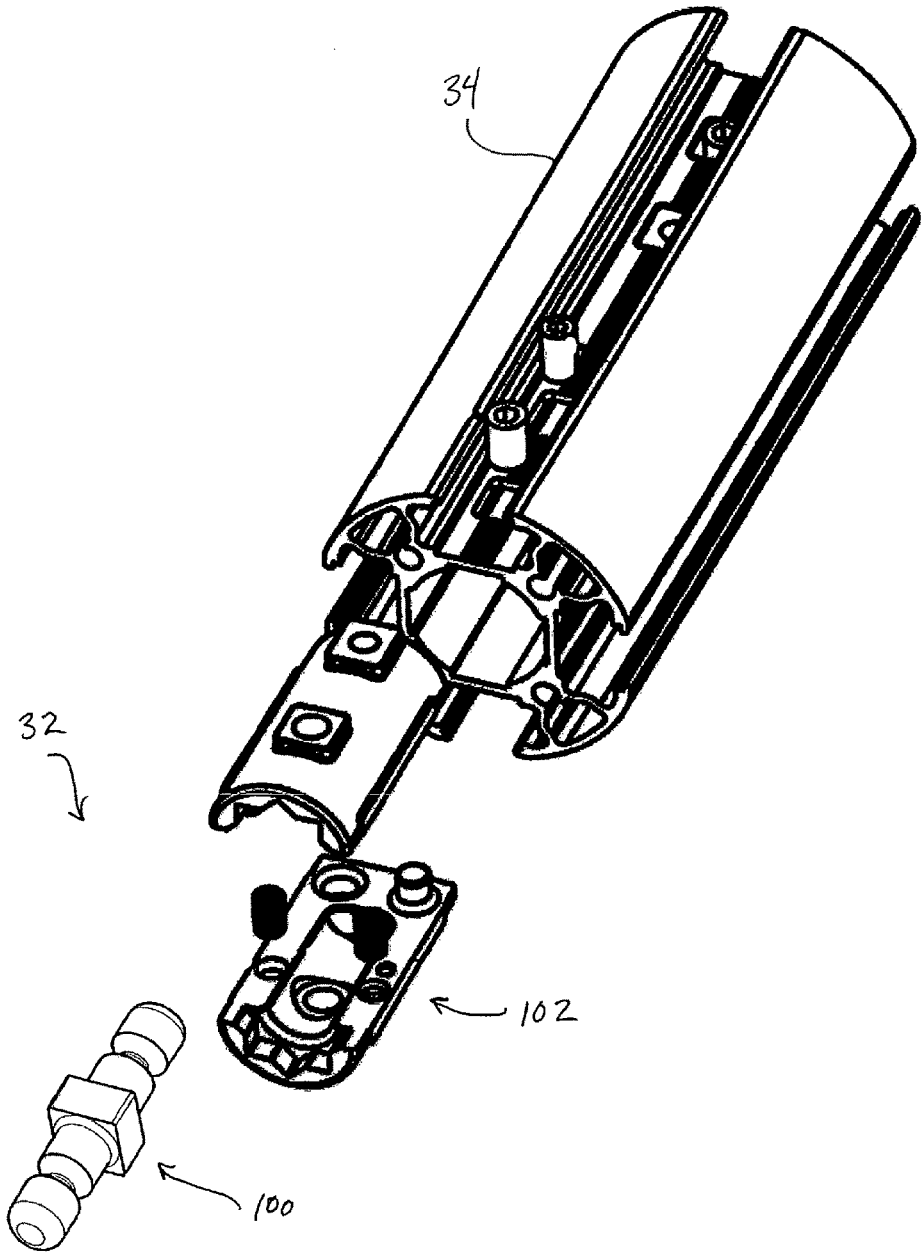
FIG. 2A is a perspective exploded view of a tubular member and a connection assembly according to another example embodiment of the present invention.

Referring to FIGS. 2-2A, framework member 34 may comprise a beam, tubular member, elongate member, or other structural member. In an example embodiment, member 34 comprises an aluminum extrusion, although other materials such as polymers or other metal alloys can also be used, and other processes known by one skilled in the art, such as casting, molding, forming, or similar, may be used. Member 34 includes channels 40, voids 42, a central bore 44, a first end 46, a body portion 48, and a second end 50. Channels 40 and voids 42 are created during the extrusion process, and can thus be shaped and configured as desired.

Member 34 may have a square outer profile, circular outer profile, rectangular outer profile, hexagonal outer profile, or any other outer profile as is desired. An example of a circular profile is depicted in FIG. 3, while an example of a square profile is depicted in FIG. 4. Tubular member 34 is generally depicted in the figures as being straight, but can be curved or partially curved depending on the desired application.

Figure 3A:
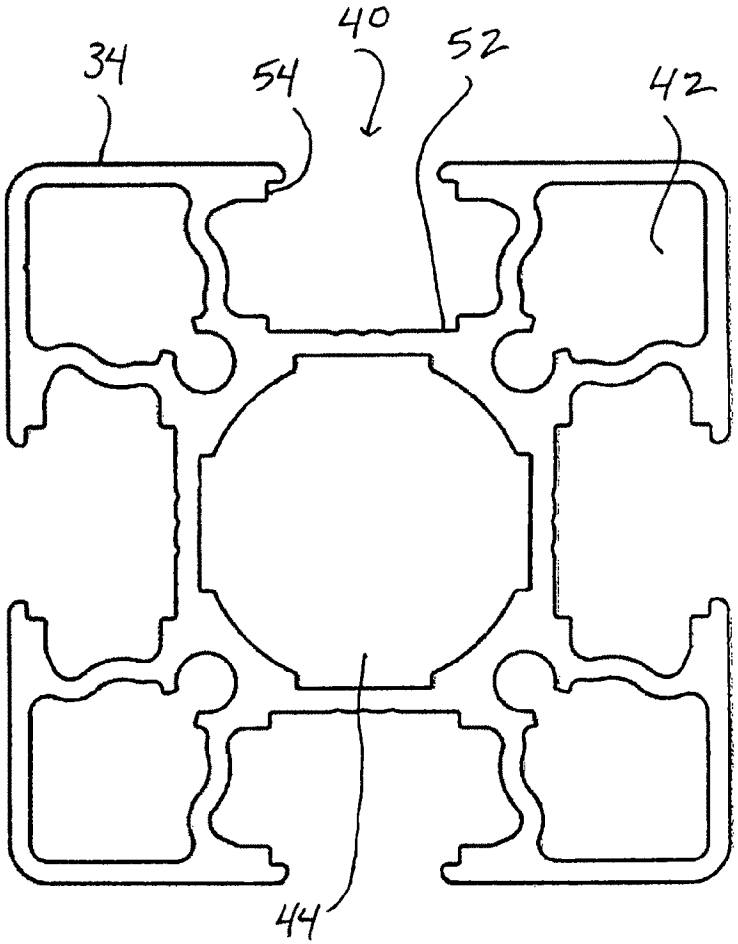
FIG. 3A is an end plan view of a square profile tubular member according to a further example embodiment of the present invention.
Figure 3:
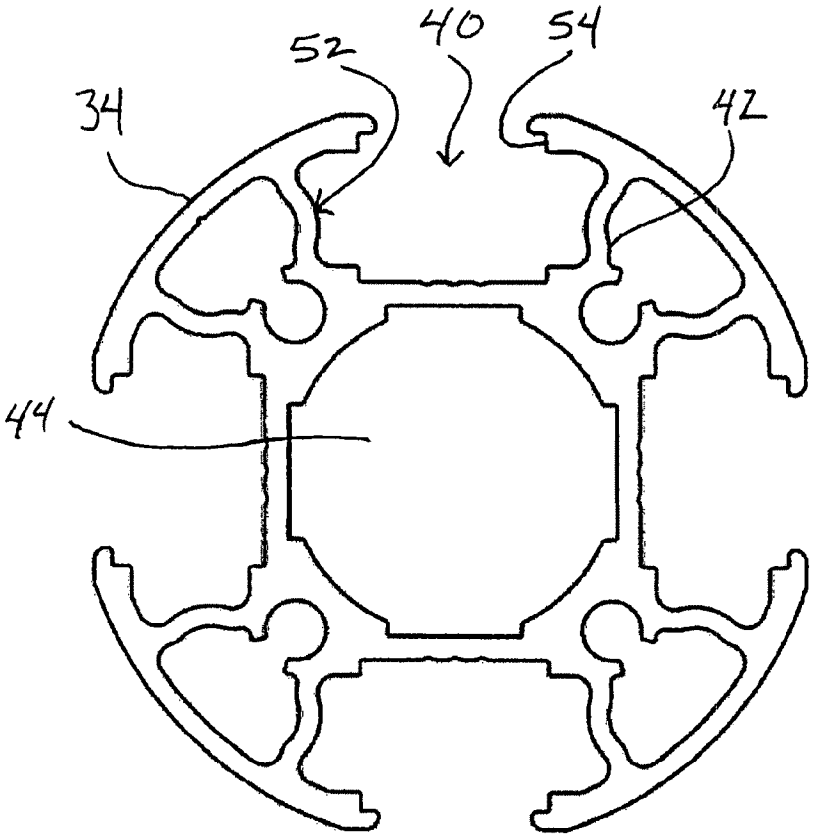
FIG. 3 is an end plan view of a circular profile tubular member according to an example embodiment of the present invention.
Figure 4:
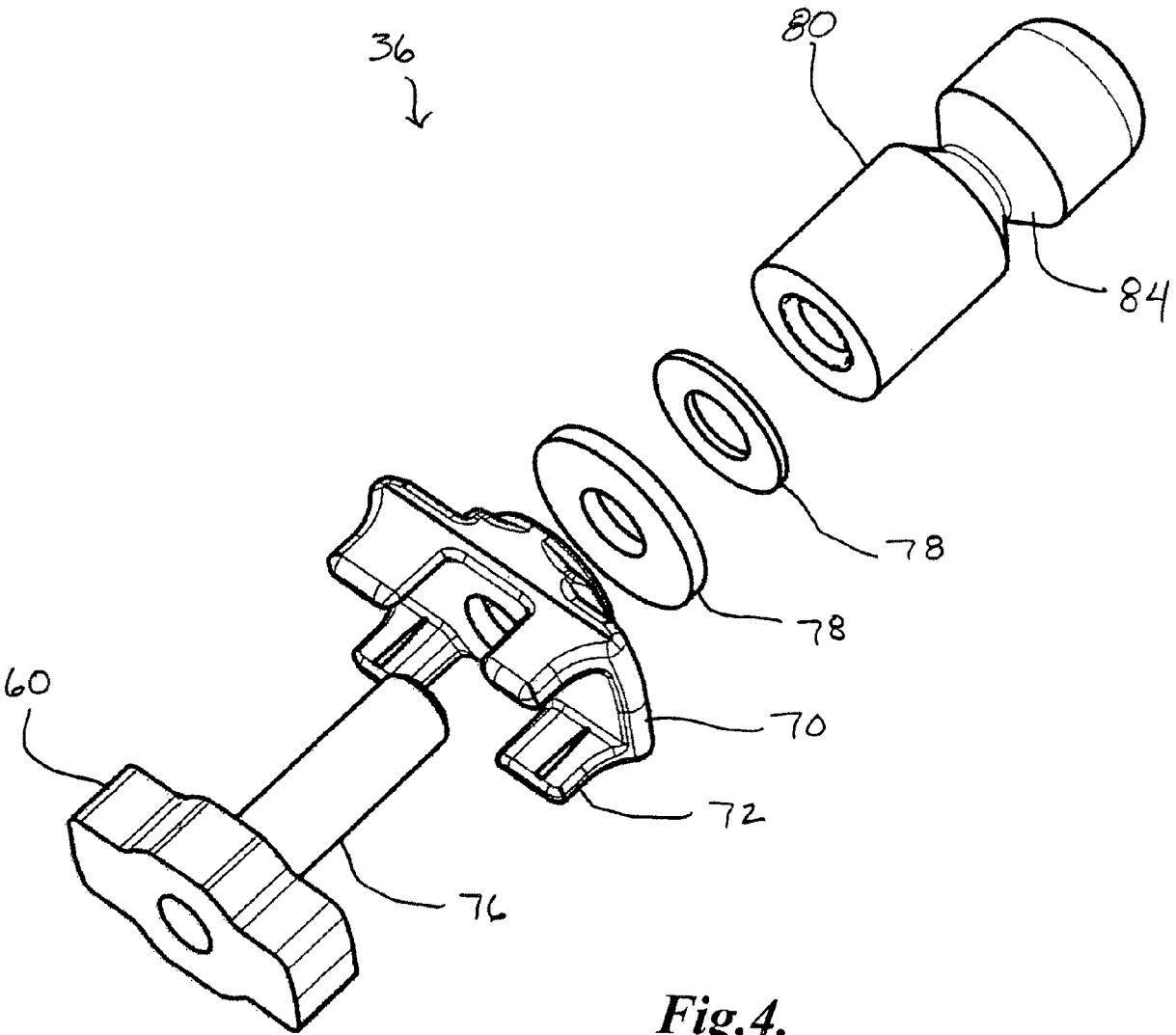
FIG. 4 is an exploded perspective view of a pin assembly according to an example embodiment of the present invention.
Figure 4A:
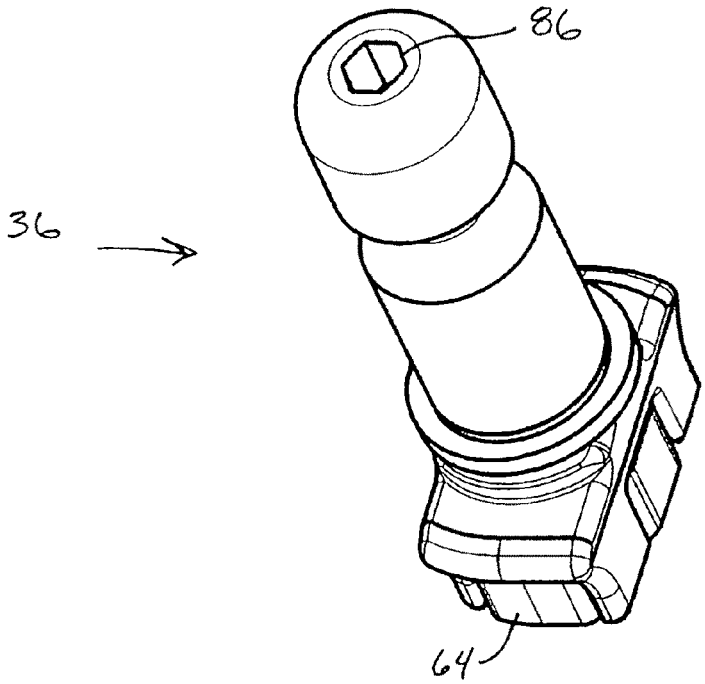
FIG. 4A is a perspective view of a pin assembly according to an example embodiment of the present invention.
Figure 4B:
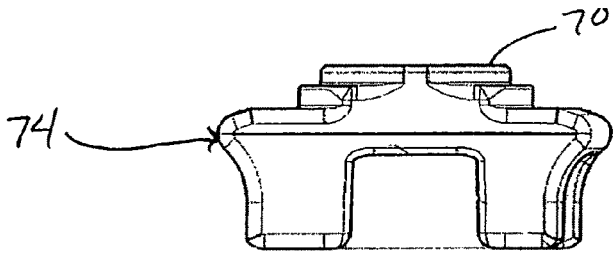
FIG. 4B is a side plan view of a component of the pin assembly according to an example embodiment of the present invention.

Channels 40 comprise a profile 52, best depicted in FIGS. 3-3A. In the example embodiments depicted in the Figures, profile 52 includes flange or lip portions 54 to be engaged by the various connection assemblies and systems placed within channel 40. Those skilled in the art will recognize that other channel profiles 40, shapes and configurations can be used. Those skilled in the art will also recognize that less than four or more than four channels 40 can be included on tubular support members 34.

Connection assembly 30 includes a quarter-turn pin assembly 36, an end cap connector 38, and a collar 102 for releasably coupling an end of a first member 34 to the body portion of a second member 35. Axial connection assembly 32 includes a connection pin 100 and at least one collar 102 for releasably coupling an end of a first member 34 to an end of a second member 35.

Figure 4C:
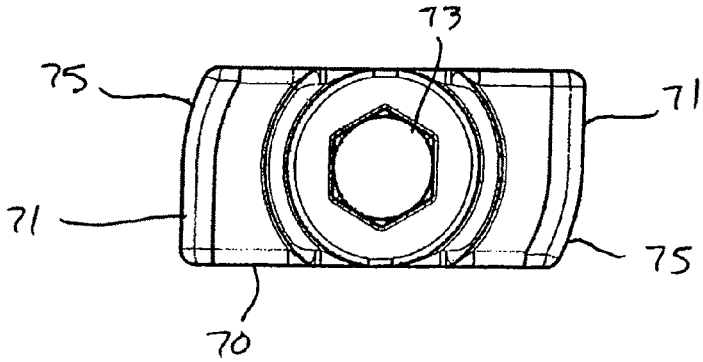
FIG. 4C is an overhead plan view of the component of FIG. 4B

Referring now to FIGS. 4-4C, pin assembly 36 includes an insert nut 60 for reinforcement, an insert 70 for engaging a channel 40, a threaded stud 76 coupled to insert nut 60, one or more optional washers 78, and a pin 80. Insert 70 has a profile 74 to conform to the profile 52 of channel 40 and provide a snug friction fit. In an example embodiment, insert 70 is constructed from a polymer, nylon, composite, or other synthetic material, while insert nut 60 comprises a reinforcement portion and is constructed from rigid material such as metal. By using a relatively soft material in the construction of insert 70, such as a polymer, repeated couplings of pin assembly 36 to tubular member 34 will not mar the surface of the tubular member. Insert nut 60 and stud 76 are coupled to insert 70, and one or more washers 78 are optionally included as shown in the Figures. Pin 80 is threaded onto stud 76 and tightened.

Insert nut 60 is coupled to stud 76, and includes curved features 64 to facilitate rotation of insert nut 60 within a channel 40.

Insert 70 includes an aperture 73 to allow stud 76 to pass therethrough. Further, insert 70 comprises curved features 75 to facilitate the rotation of insert 70 within a channel 40. Insert 70 also includes tabs 72 to rotatably retain nut 60. Insert 70 includes a profile 74 that matches channel profile 52 of member 34.

In an example embodiment, an insert nut 60 is not provided in pin assembly 36, rather insert 70 is both rigid and easily engageable with a channel 40. In a further example embodiment, insert 70 comprises a polymer overmolded onto a rigid backbone such as metal.

Pin 80 includes an engagement portion 84, depicted in the Figures as a circumferential groove. In an example embodiment, engagement portion 84 is configured to be engaged by a set screw having a conical tip so as to couple pin 80 to a tubular member (described below).

Pin 80 further includes a feature 86 to receive a tool for turning pin assembly 36. As depicted in the Figures, feature 86 comprises an internal hex profile to receive a hex key. However, feature 86 may also comprise a slot or cross to receive a standard or Phillips screwdriver, respectively. Feature 86 may also comprise an external hex profile to receive a wrench, or feature 86 may comprise other configurations as will be apparent to one skilled in the art.

Figure 5B:
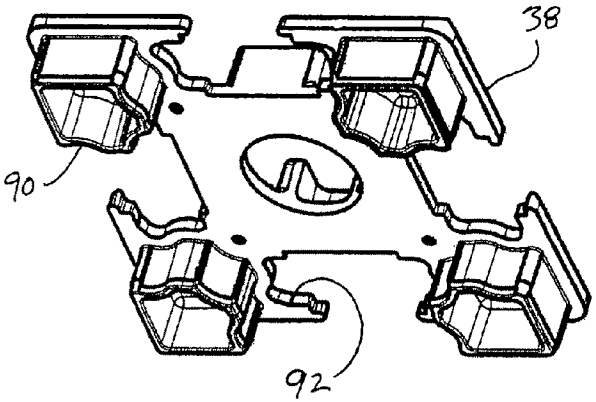
FIG. 5B is a perspective view of a second side of a faceplate according to an example embodiment of the present invention.
Figure 5C:
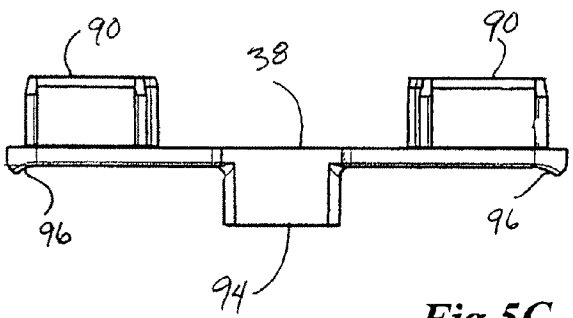
FIG. 5C is a side view of a faceplate according to an example embodiment of the present invention.
Figure 5:
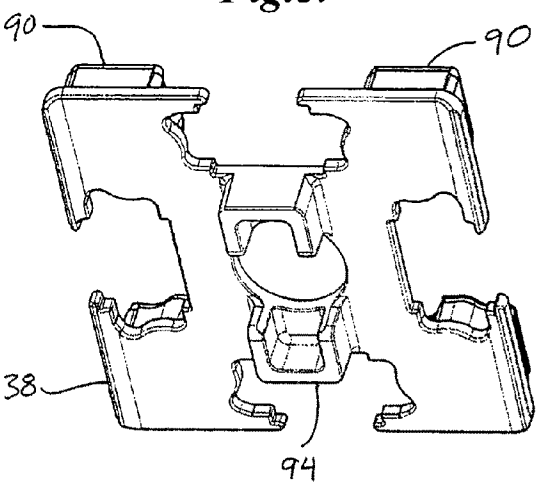
FIG. 5 is a perspective view of a first side of a faceplate according to an example embodiment of the present invention.
Figure 5A:
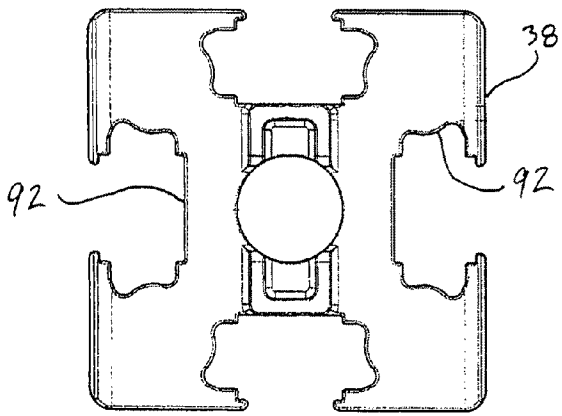
FIG. 5A is a plan view of the first side of the faceplate of FIG. 5.

Referring now to FIGS. 5-5C, conforming faceplate 38 is configured to be joined between the end of a first tubular member and the body of a second tubular member to provide cushioned engagement. In an example embodiment, faceplate 38 is constructed of a polymer, nylon, composite, or other synthetic material. A relatively soft material resists marring the surface of the tubular members, as may occur with repeated assembling and disassembling. Although faceplate 38 is depicted in the Figures as having a square profile, faceplate 38 can be constructed in any desired shape to match the shape of member 34, such as circular, rectangular, octagonal, etc. Included on one side of faceplate 38 are protrusions 90, adapted to be inserted into voids 42 in the end of a tubular member 34. Optionally, faceplate 38 includes cutouts 92 to match channel profile 52 of tubular member 34. Projecting from the other side of faceplate 38 are conforming or transition features 96 and a locator portion 94 adapted to be received in channel 40 of tubular member 34 and also to surround insert 70 when insert 70 is in a locked orientation.

Protrusions 90 and locator portion 94 jointly act to rotationally restrain and align the two tubular members when connected. Rotation of one tubular member with respect to the other while coupled is therefore prevented by faceplate 38. Conforming features 96, as depicted in FIG. 5C, are adapted to conform to the profile of a square tubular member 34 such as depicted in FIG. 3A. In the case of using a faceplate 38 with a circular tubular member 34 such as depicted in FIG. 3, conforming features 96 will be configured accordingly to provide a snug retention against the circular profile of tubular member 34. In an example embodiment, faceplate 38 may include a perimeter lip portion to aid retention and alignment of a tubular member thereto.

As depicted in the Figures, faceplate 38 is configured for orthogonally joining an end of a first square-profiled tubular member to the body of a second square-profiled tubular member. Faceplate 38 therefore comprises a square shape and is substantially planar, with protrusions 90 on one side and locator portion 90 on the other side. However, if it desired to join an end of a first tubular member to the body of a circular-profiled tubular member, faceplate 38 may be non-planar to conform to the curved surface of the body of the circular-profiled tubular member. As discussed above, faceplate 38 may further include conforming features 96 to provide a solid connection between the body of a circular-profiled tubular member and the end of another tubular member.

Referring now to FIGS. 2-2A, a double-sided pin 100 and engagement collar 102 are depicted. Pin 100 and collar 102 are utilized when joining two tubular members end-to-end in an axial orientation. Collar 102 is utilized with pin assembly 36 when joining the end of a first tubular member to the body of a second tubular member.

Pin 100 includes a first end 110 having an engagement portion 112, a second end 114 having an engagement portion 116, and a middle portion 118. In an example embodiment depicted in the Figures, engagement portions 112 and 116 comprise a circumferential groove so as to be engaged by a set screw so as to couple pin 100 between two tubular members. Mid portion 118 comprises a square-shaped flange.

Collar 102 comprises a first half 120 and a second half 122, each half including a pin receiving portion 124 and a flange receiving portion 126. A pin 128 of one half of collar 102 interacts with a bore 130 of the other half of collar 102 to keep the two halves aligned when the two halves are assembled. One or more locator portions 132 are included on one half of collar 102, the locator portions adapted to engage retention features 56 in a tubular member when collar 102 is inserted into bore 44 of a tubular member. One or more springs 136 are provided to bias first half 120 and second half 122 away from one another and therefore in engagement with retention features 56, such that collar 102 is a spring-loaded conforming insert. Locator portions 132 may include apertures 134 to facilitate the use of one or more set screws. A set screw (or other suitable fastener) 138 may be used to mechanically separate each half of collar 102, the set screw 138 being advanced through aperture 134 of the rear locator portion of first half 120, until set screw 138 engages second half 122. A further set screw (or other suitable fastener) 140 is provided for engaging a pin 80 or a pin 100 upon the pin being inserted into collar 102. Flange receiving portion 126 is configured to engage mid portion 118 of pin 100.

Figure 11:
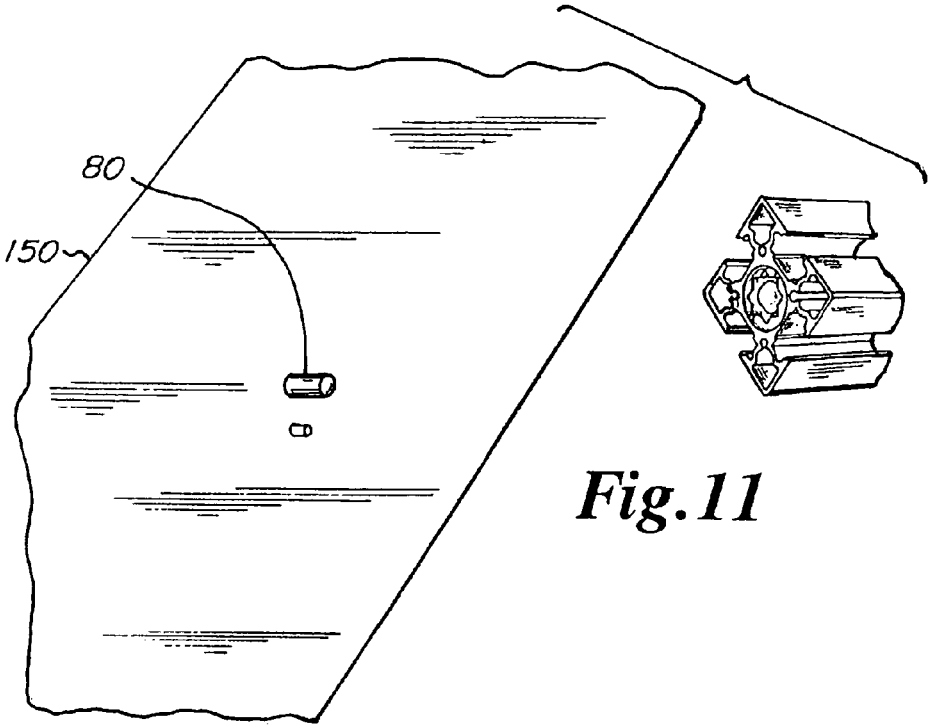
FIG. 11 is a perspective view of a base plate for supporting a tubular member according to an example embodiment of the present invention.
Figure 11A:
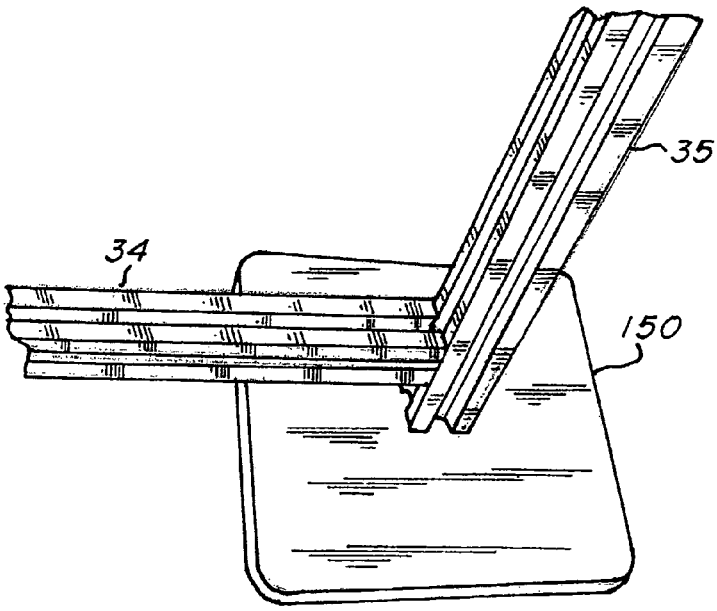
FIG. 11A is a perspective view of a base plate having a tubular member attached thereto according to an example embodiment of the present invention.
Figure 12:
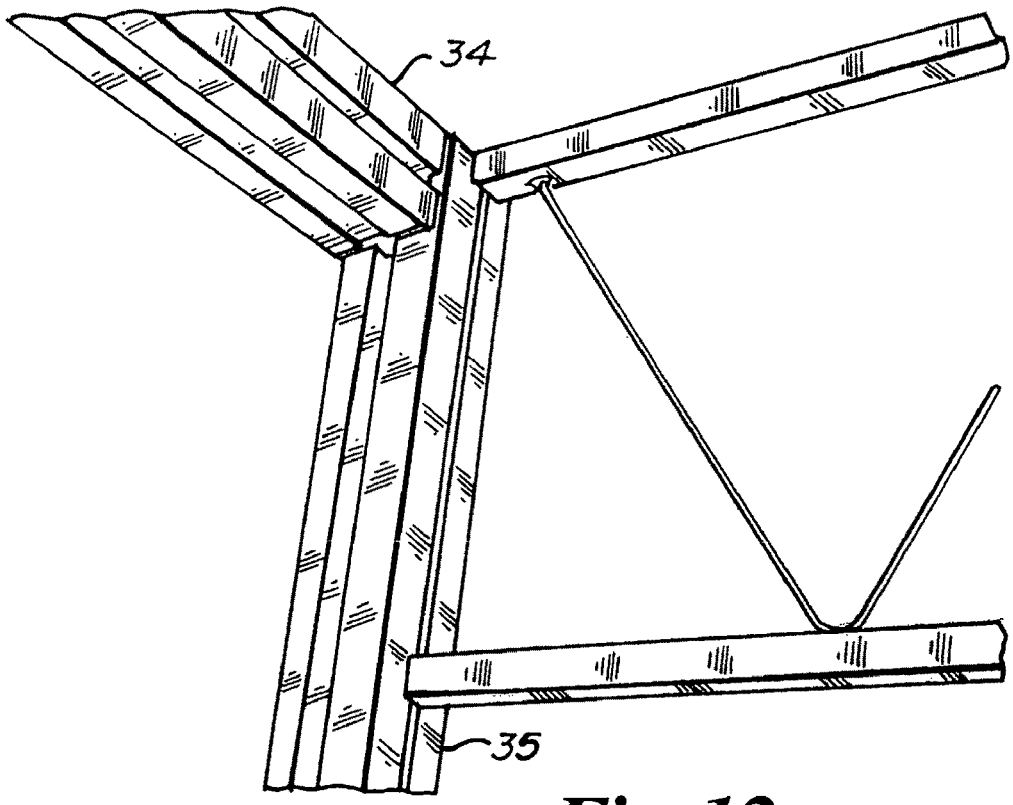
FIG. 12 is a perspective view of a tubular member having an accessory attached thereto.

Various accessories 150 may be included in exhibit 28. Examples of accessories 150 may include a shelf, a counter, a table, a base plate as depicted in FIGS. 11-11A, a light fixture, height adjustable (or leveling) feet, a banner (as described in co-filed application entitled "BANNER CONNECTION SYSTEM AND METHOD," filed on the same filing date as this application, the disclosure of which is hereby incorporated by reference in its entirety), a decorative channel cover, a mounting bracket, a backdrop, a panel, decorative structures, or a graphic display. Accessories 150 may be releasably coupled to an end of a tubular member or to the body portion of a tubular member, using connection assembly 30, connection assembly 32, or other connection methods known to one skilled in the art. Examples of other connection methods and exhibit configurations are described in U.S. Pat. No. 7,024,834, U.S. Patent Publication No. 2006/0242923, and U.S. Patent Application No. 2004/0055244, the disclosures of which are incorporated herein by reference in their entirety.

Figure 6:
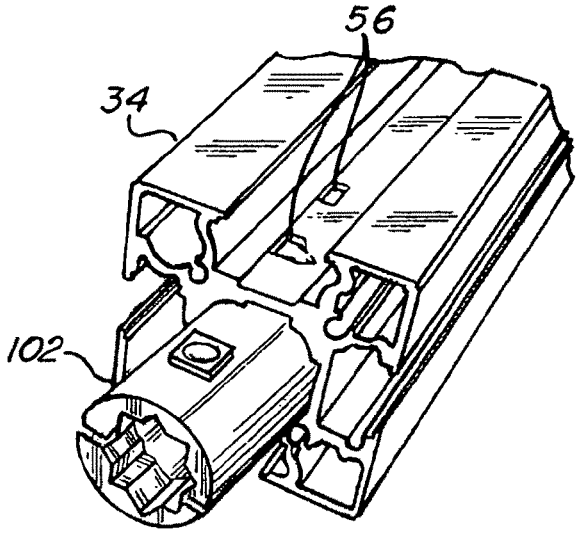
FIG. 6 is a perspective view of a collar partially inserted into a tubular member according to an example embodiment of the present invention.
Figure 7:
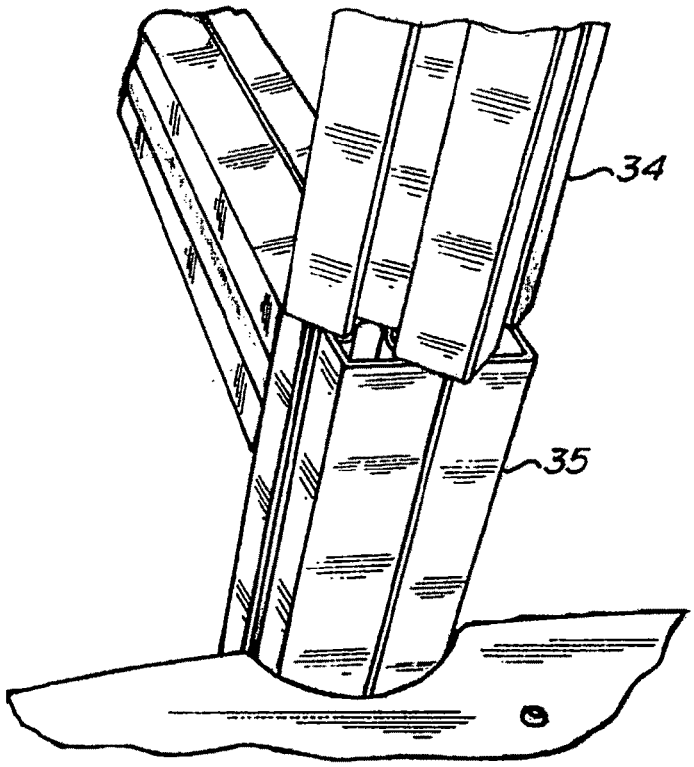
FIG. 7 is a perspective view of two tubular members coupled together at a rotational offset according to an example embodiment of the present invention.

Referring to FIGS. 6 and 7, turning now to methods of connecting two or more tubular members, a method of connecting two tubular members end-to-end, or axially, comprises the following. A first tubular member 34 and a second tubular member 35 are provided, each tubular member including an exterior channel 40 having a profile 52, and a central bore 44 in communication with a retention feature 56. In an example embodiment central bore 44 comprises a generally circular shape having flattened portions. A collar 102 is inserted into bore 44 of each tubular member, such as depicted in FIG. 6, wherein flattened portions of bore 44 provide clearance for locator portions 132 of collar 102. Each half 120 and 122 of collar 102 are compressed against each other to allow insertion of collar 102 into bore 44. Collar 102 is inserted until locator portions 132 engage retention features 56 in the tubular member. Springs 136 act to bias each half of collar 102 away from one another, thereby acting to retain collar 102 in bore 44 of tubular member. Additionally, a set screw 138 may be advanced through an aperture 134 to mechanically separate each half of collar 102 ensuring locator portions 132 remain engaged in retention features 56 and thereby collar 102 remains in bore 44.

A pin 100 is provided, and a first end 110 of pin 100 is inserted into the collar in a first tubular member. A set screw 140 is advanced through collar 102 into engagement portion 112 on pin 100, thereby coupling first end 110 of pin 100 within the collar. Second tubular member is axially aligned with first tubular member, such that the first and second tubular members are end-to-end. First and second tubular members are brought together, thereby causing second end 114 of pin 100 to be inserted in the collar of second tubular member. A set screw is advanced into engagement portion 116 on pin 100, thereby coupling second end 114 of pin 100 in the collar, and thereby coupling first and second tubular members together end-to-end. In an example embodiment, the end-to-end connection between the two tubular members is a metal-on-metal interface.

When coupling two tubular members together end-to-end, the tubular members may be oriented such that the channels 40 of each tubular member are aligned. Alternatively, the tubular members may be oriented such that the channels 40 are rotationally offset at an angle with respect to one another, such as forty-five degrees as depicted in FIG. 7. Collar 102 includes a flange receiving portion 126 having selective positioning portions 127. When engaging pin 100 with collar 102, mid-portion 118 can be selectively positioned in receiving portion 126 such that two tubular members are rotationally aligned with respect to each other. Mid-portion 118 may be alternately selectively positioned such that the two tubular members are rotationally offset from one another.

A method of connecting an end of a first tubular member to the body of a second tubular member comprises the following. A first tubular member 34 and a second tubular member 35 are provided, each tubular member including an exterior channel 40 having a profile 52, and a central bore 44 in communication with a retention feature 56. In an example embodiment central bore 44 comprises a generally circular shape having flattened portions. A collar 102 is inserted into bore 44 of the second tubular member, wherein flattened portions of bore 44 provide clearance for locator portions 132 of collar 102. Each half 120 and 122 of collar 102 are compressed against each other to allow insertion of collar 102 into bore 44. Collar 102 is inserted until locator portions 132 engage retention features 56 in the tubular member. Springs 136 act to bias each half of collar 102 away from one another, thereby acting to retain collar 102 in bore 44 of tubular member. Additionally, a set screw 138 may be advanced through an aperture 134 to separate each half of collar 102, ensuring collar 102 remains in bore 44.

Figure 8:
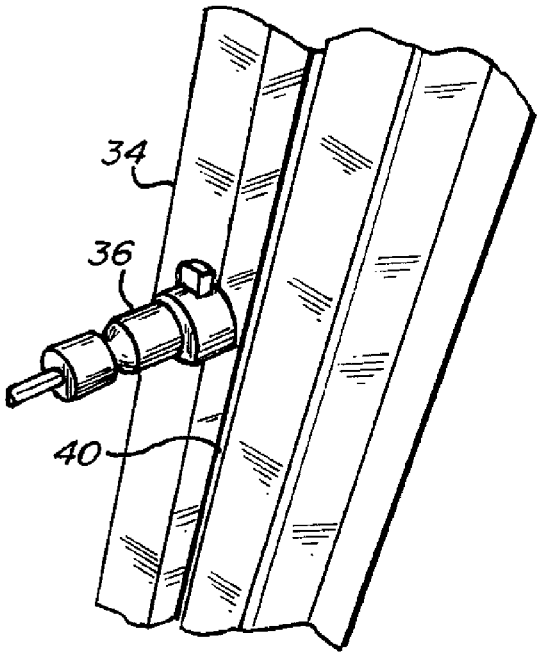
FIG. 8 is a perspective view of a pin assembly according to an example embodiment of the present invention.
Figure 8A:
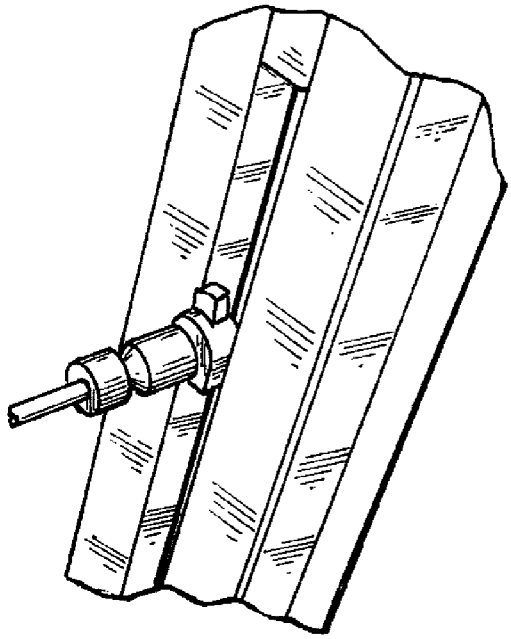
FIG. 8A is a perspective view of a pin assembly partially inserted into a channel of a tubular member according to an example embodiment of the present invention.
Figure 8B:
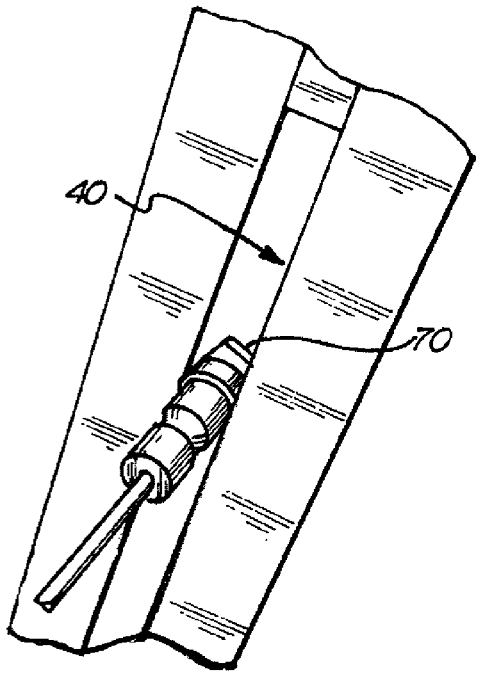
FIG. 8B is a perspective view of a pin assembly being moved from an insert orientation toward a locked orientation according to an example embodiment of the present invention.
Figure 8C:
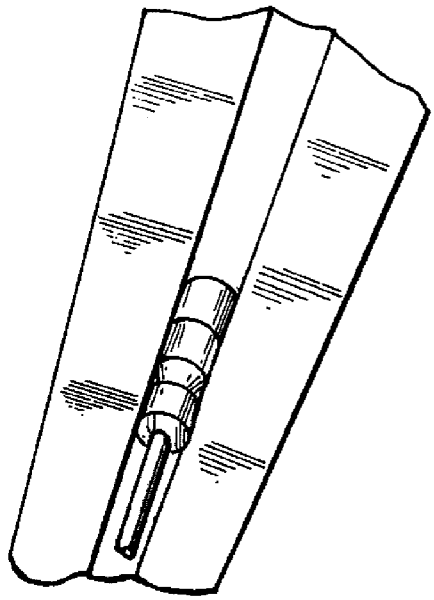
FIG. 8C is a perspective view of a pin assembly being moved from an insert orientation toward a locked orientation according to an example embodiment of the present invention.
Figure 9:
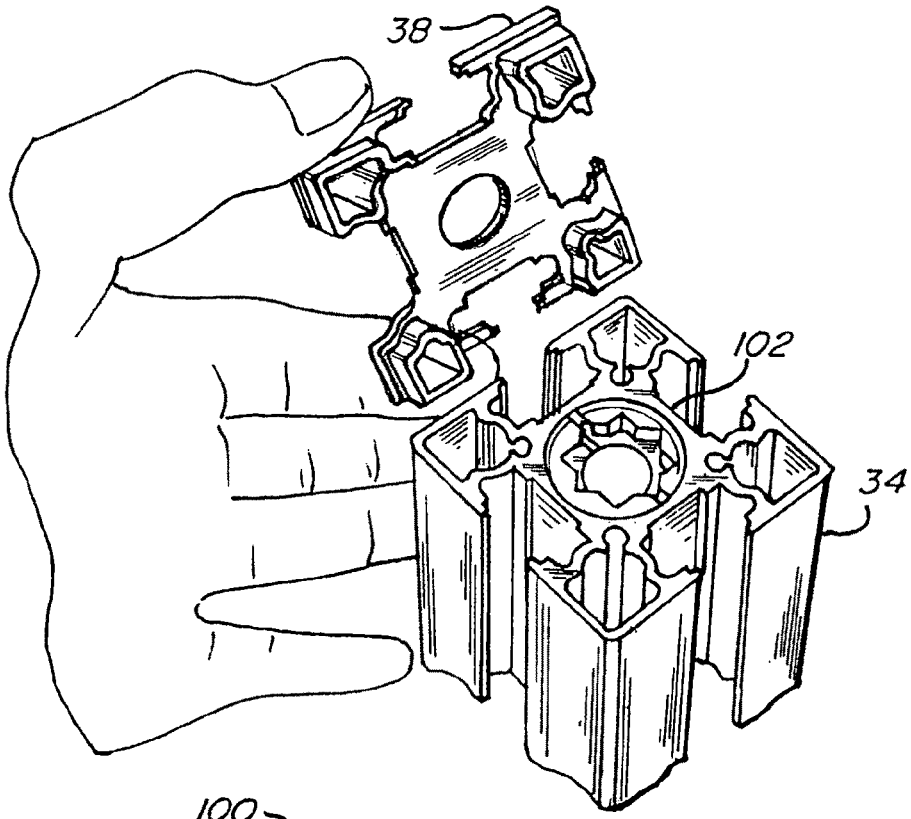
FIG. 9 is a perspective view of a faceplate proximate an end of a tubular member according to an example embodiment of the present invention.

Referring to FIGS. 8-8C, pin assembly 36 is provided, and is first positioned such that insert 70 is able to be inserted into channel 40 of first tubular member 34. Insert 70 is placed in channel 40, and rotated a quarter-turn to a locking position, thereby locking pin assembly 36 in channel 40. Curved features 75 are provided on insert 70 to facilitate rotation in channel 40, and side portions 71 of insert 70 are provided to engage channel profile 52. Once in the locking position, pin assembly 36 is secured in channel 40 of first tubular member 34.

Figure 10:
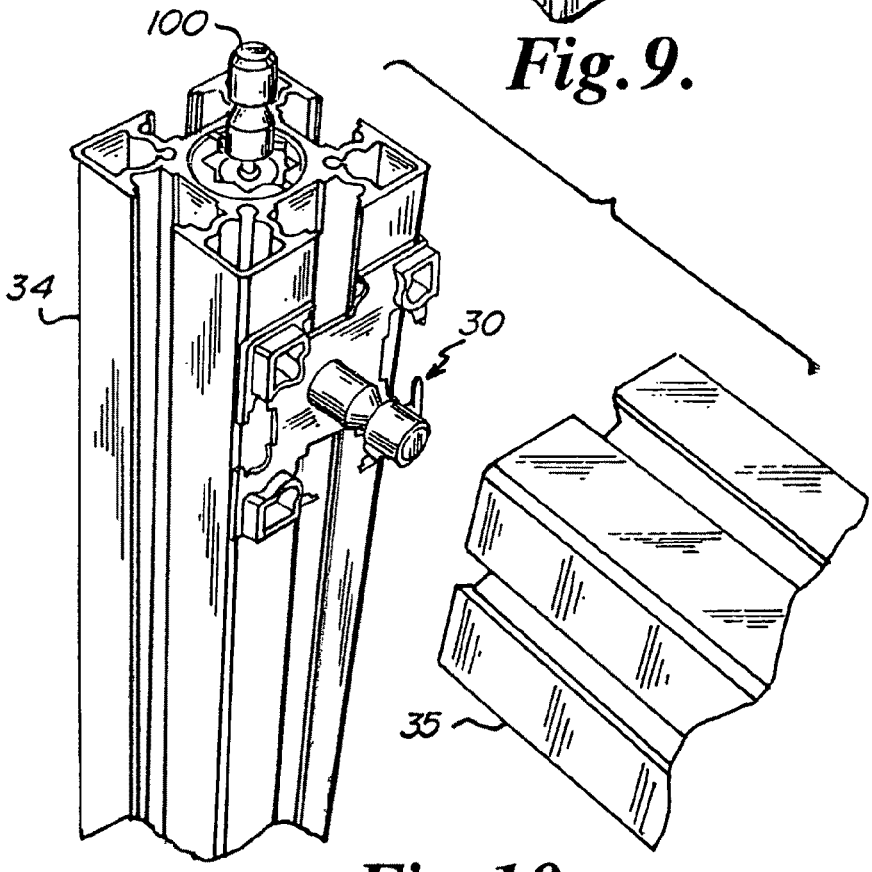
FIG. 10 is a perspective view of a connection assembly according to an example embodiment of the present invention.
Figure 10A:
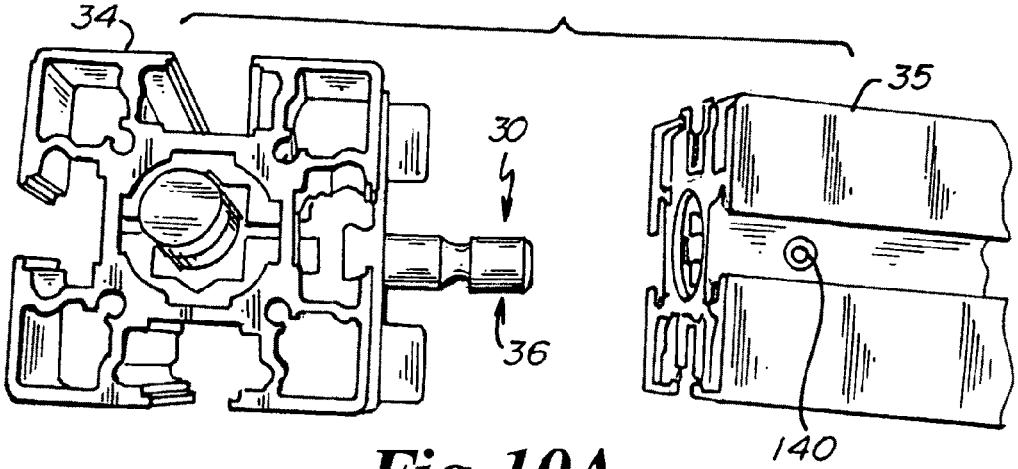
FIG. 10A is an overhead perspective view of a connection assembly according to an example embodiment of the present invention.
Figure 10B:
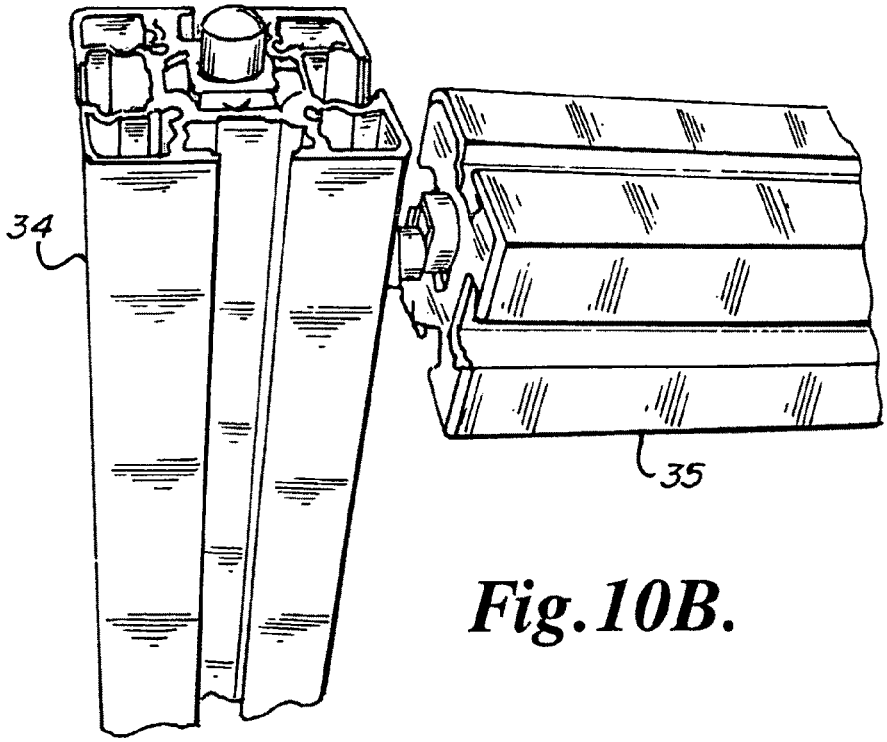
FIG. 10B is a side perspective view of a partially assembled connection between two tubular members.
Figure 10C:
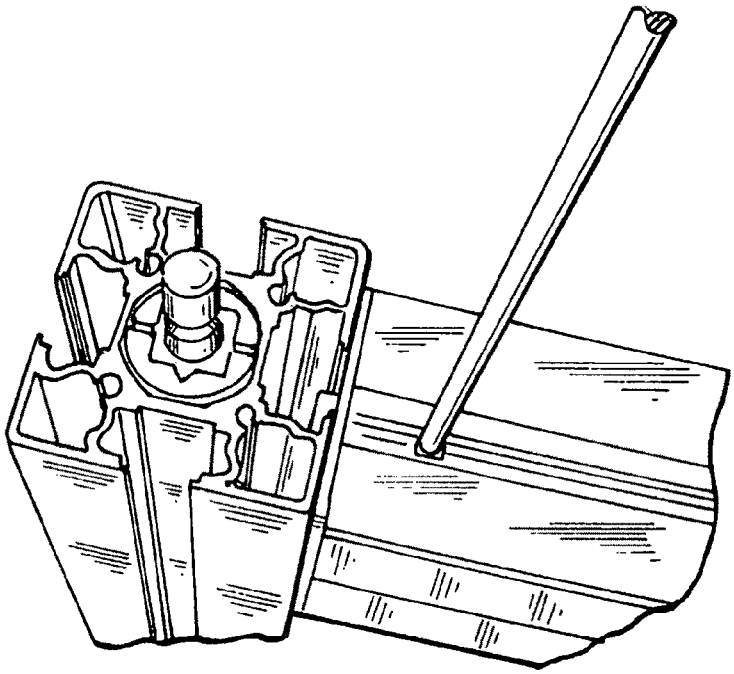
FIG. 10C is an overhead perspective view of a partially assembled connection between two tubular members.
Figure 10D:
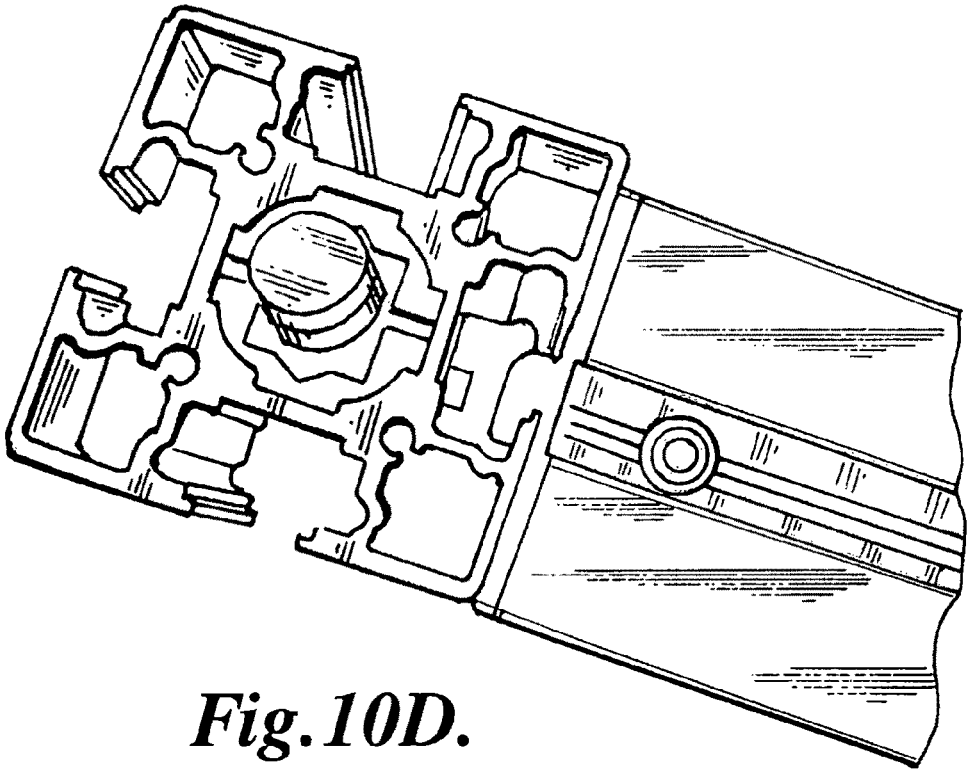
FIG. 10D is an overhead perspective view of a fully assembled connection between two tubular members.

As depicted in FIGS. 10-10D, collar 102 in second tubular member 35 and pin assembly 36 of first tubular member 34 are brought together, such that pin 80 is inserted into pin receiving portion 124 of collar 102. A set screw 140 is advanced into engagement portion 84 of pin 80, thereby coupling first tubular member to second tubular member.

Faceplate 38 may be included between first tubular member 34 and second tubular member 35. Protrusions 90 on faceplate 38 are configured to be securely located in voids 42 in first tubular member 34 and locator portion 94 is configured to securely surround insert 70, such that faceplate 38 provides additional stability in the junction between the tubular members.

In an example embodiment, the end-to-body connection between the two tubular members is a metal-polymer-metal-polymer-metal sandwich, constructed of reinforcing insert nut 60, insert 70, flange portion 54, faceplate 38, and an end of a tubular member, respectively.

In an example embodiment, an end of a tubular member may be releasably coupled to the body portion of another tubular member such that the tubular members are orthogonal. In another example embodiment, an end of a tubular member may be releasably coupled to the body portion of another tubular member such that the tubular members are not orthogonal, but rather the tubular members form an acute or obtuse angle with respect to each other in one or more planes. In such an embodiment, faceplate 38 may be constructed to fill in any space between the tubular members created by the angle of attachment, such as by having modified conforming or transition features 96 to ensure a snug fit between the tubular members. In such an embodiment, some or all of pin assembly 36 may be modified to facilitate joining the tubular members at an angle.

In another example, the end of a tubular member may be releasably coupled to a body portion that does not presend a flat surface, for example a round tubular support member may be attached to with one side of the faceplate have a conforming configuration to follow the curved body shape.

The present invention also comprises a portable exhibit kit 160 not depicted in the Figures. Kit 160 comprises a container 162, and a collapsible multi-configurable exhibit 28. Container 162 is configured to house a disassembled exhibit for shipping or storage, and may be similar to the container disclosed in U.S. Pat. No. 6,951,283 to Savoie, the disclosure of which is hereby incorporated by reference in its entirety. In the present invention, container 162 is configured to house a plurality of tubular members 34, an axial connection assembly 32, a connection assembly 30, and one or more accessories 150. Exhibit 28 is adapted to be collapsible, and fit within container 162. Upon removal from container 162, exhibit 28 is adapted to be set-up in a variety of different configurations to meet the desired application. In an example embodiment of kit 160, the tubular members comprise a length of less than forty-eight inches. In a further example embodiment of kit 160, the tubular members comprise a length of less than or equal to forty-six inches. Often, tradeshow halls place restrictions on the height of erected therein, and a common current height restriction is ninety-two inches. By constructing tubular members less than or equal to forty-six inches, two tubular members can be vertically coupled and remain within the required height.

Although the present invention has been described with reference to particular embodiments, one skilled in the art will recognize that changes may be made in form and detail without departing from the spirit and scope of the invention. Therefore, the illustrated embodiments should be considered in all respects as illustrative and not restrictive.

The invention claimed is:

1. A multi-configurable exhibit, comprising:

a framework including a plurality of tubular support members each having opposing ends and a body portion, the support members including an exterior channel and a central bore, the channel defining a flange portion and the bore being in communication with a retention feature;

an axial connection assembly configured to releasably couple an end of a first support member to an end of a second support member such that the two support members are axially aligned, the connection assembly including:

a collar releasably coupled in the bore of each of the first and second support members, each collar including at least one locator portion that engages and directly interlocks with the retention feature, each collar comprising first and second portions that are biased away from each other such that the collar can be compressed into a compressed configuration for insertion into the bore and then expanded into an expanded configuration to engage the at least one locator portion with the retention feature; and a pin having a mid portion and two ends, the mid portion configured to be rotationally selectively positioned within the collar.

2. The multi-configurable exhibit of claim 1, further comprising a second connection assembly adapted to releasably couple an end of a third support member to the body portion of the second support member.

3. The multi-configurable exhibit of claim 2, wherein each tubular member including an exterior channel having a profile, and a central bore in communication with a retention feature, the second connection assembly comprising:

a quarter-turn pin assembly configured to be releasably retained within an exterior channel, the pin assembly comprising:

a pin; and an insert coupled to the pin, the insert configured to be inserted into the channel in a first orientation and configured to be related to a second orientation such that the insert is releasably locked in the channel, the insert having a profile that matches the profile of the channel;

a collar releasably coupled in the bore of the first member, the collar including at least one locator portion to engage the retaining feature; and a fastener adapted to selectively couple the collar and the pin.

4. The multi-configurable exhibit of claim 1, further comprising an accessory releasably coupled to one more tubular members.

5. A portable exhibit kit, comprising:

a plurality of identical tubular members, each member including opposing ends and a body, a central bore in communication with a retention feature and an exterior channel having a profile;

an axial connection assembly adapted to releasably couple an end of a first tubular member to an end of a second tubular member;

a second connection assembly adapted to releasably couple an end of a third tubular member to the body of the second tubular member, the second connection assembly comprising a quarter-turn pin assembly configured to be releasably retained within the exterior channel of the second tubular member, the pin assembly comprising a pin, an insert having a profile that matches the profile of the channel coupled to the pin and configured to be inserted into the channel in a first orientation and configured to be rotated within the channel to a second orientation such that the insert is releasably locked in the channel, a collar releasably coupled in the bore of the third member, and a fastener adapted to selectively couple the collar and the pin;

one or more accessories adapted to be releasably coupled to one more tubular members; and a container adapted to store the plurality of tubular members, the axial and second connection assemblies, and the one or more accessories.

6. The portable exhibit kit of claim 5, wherein the axial connection assembly comprises:

a pin including a mid portion and two ends;

a collar releasably coupled in the bore of each member, each collar including at least one locator portion to engage and directly interlock with the retention feature;

a fastener adapted to selectively couple the collar and the pin.

7. A connection assembly for connecting two tubular members end to end, each tubular member including a central bore in communication with a retention feature, the connection assembly comprising:

a pin including a mid portion and two ends;

a collar releasably coupled in the bore of each member, each collar including at least one locator portion to directly engage and interlock with the retention feature, the collar comprising first and second portions that are biased away from each other such that the collar can be compressed into a compressed configuration for insertion into the bore and then expanded into an expanded configuration to engage the at least one locator portion with the retention feature;

a fastener adapted to selectively couple the collar and the pin.

8. A connection assembly for connecting an end of a first tubular member to the body of a second tubular member, each tubular member including an exterior channel having a profile, and a central bore in communication with a retention feature, and each tubular member having four generally planar sides defining a generally square cross-section, the connection assembly comprising:

a pin assembly configured to be releasably retained within the exterior channel of the second tubular member, the pin assembly comprising:

a pin; and an insert coupled to the pin, the insert configured to be releasably locked in the channel, the insert having a profile that matches the profile of the channel;

a collar releasably coupled in the bore of the first member;

a fastener adapted to selectively couple the collar and the pin; and a faceplate positioned between the end of the first tubular member and one of the planar side surfaces of the body of the second tubular member including the exterior channel, the faceplate having a planar interior surface conforming to the planar side surface of the second tubular member and at least one unitary locator portion that is received in the channel to connect the faceplate to the second tubular member, the faceplate further including unitary axially extending protrusions extending into voids in the end of the first tubular member, thereby providing a conforming interface preventing contact between the end of the first tubular member and the side surface of the second tubular member to prevent damage to the body of the second tubular member.

9. The connection assembly of claim 8, wherein the collar comprises first and second portions that are biased away from each other such that the collar can be compressed into a compressed configuration for insertion into the bore and then expanded into an expanded configuration to engage at least one locator portion on the collar with the retention feature.

10. A method of connecting a plurality of tubular members, each tubular member including an exterior channel having a profile, and a central bore in communication with a retaining feature, the method comprising:

providing a quarter-turn pin assembly, comprising a pin and an insert coupled to the pin, the insert having a profile that matches the profile of the channel of a second tubular member;

providing a collar, the collar including at least one locator portion and being adapted to fit within the bore of a first tubular member;

inserting the collar into the bore of the first tubular member, such that the locator portion directly engages and interlocks with the retaining feature in the first tubular member;

orienting the pin assembly such that the insert is aligned with the channel of a second tubular member;

inserting the pin assembly into the channel of the second tubular member in a first orientation;

rotating the pin assembly within the channel of the second tubular member to a second orientation such that the insert is releasably locked in the channel of the second tubular member;

inserting the pin of the pin assembly into the collar; and engaging a fastener to selectively couple the collar and the pin, thereby connecting the first and second tubular members.

11. A method of connecting two tubular members axially, each tubular member including a central bore in communication with a retention feature, the method comprising:

providing a pin including a mid portion and two ends;

providing a collar for each tubular member, each collar including at least one locator portion to directly engage and interlock with the retention feature, and each collar being adapted to fit within the bore;

releasably coupling each collar in the bore of the respective tubular member by compressing each collar into a compressed configuration by overcoming a bias that biases a first portion of each collar and a second portion of each collar away from each other to insert each collar into the respective bore, and then allowing each collar to return to an expanded configuration such that the locator portion directly engages and interlocks with the retention feature;

inserting one end of the pin into a first collar in one member;

engaging a fastener to selectively couple the first collar and the pin;

aligning the first member and the second member and inserting the pin into the second collar; and engaging a fastener to selectively couple the second collar and the pin, thereby axially connecting the two tubular members.

12. The method of claim 11 further comprising insertion of a faceplate formed of a polymer material intermediate the two tubular members, the faceplate having protrusions extending axially into each tubular member.

13. A method of connecting an end of a first tubular member to a body of a second tubular member, the body including four generally planar sides defining a generally square-shaped cross section, the second tubular member including an exterior flanged channel having a profile on at least on of the generally planar sides, and a central bore of the first tubular member in communication with a retention feature, the method comprising:

providing a pin assembly, comprising a pin and an insert coupled to the pin, the insert having a profile that matches the profile of the channel;

providing a collar, the collar including at least one locator portion and being adapted to fit within the bore;

securing the collar into the first tubular member;

orienting the pin assembly such that the insert is aligned for inserting into the channel of the second tubular member;

inserting a faceplate intermediate the first tubular member and the second tubular member, including inserting at least one unitary locator portion of the faceplate into the channel of the second tubular member and inserting unitary axially extending protrusions of the faceplate into voids in the end of the first tubular member, the faceplate having a planar interior surface conforming to a shape of the side surface of the second tubular member and providing a conforming interface preventing contact between the end of the first tubular member and the side surface of the second tubular member to prevent damage to the body of the second tubular member;

inserting the pin assembly into the channel;

moving the pin assembly to a second orientation such that the insert is releasably locked in the channel; and securing the pin in position rotationally and axially within the first tubular member.

14. The method of claim 13 further comprising the step of preventing rotation of the first tubular member with respect to the second tubular member by extending the protrusions of the faceplate into voids in the first tubular member and the locator portion into the channel of the second tubular member.

15. The method of claim 14 further comprising the step of selecting the material of the faceplate to be a polymer.

16. The method of claim 14, wherein the step of securing the collar into the first tubular member comprises compressing the collar into a compressed configuration by overcoming a bias that biases a first portion of the collar and a second portion of the collar away from each other to insert the collar into the bore of the first tubular member and allowing the collar to return to an expanded configuration to directly engage and interlock the at least one locator portion with the retention feature.

* * * * *